US009609922B2

(12) United States Patent
Fujimura

(10) Patent No.: US 9,609,922 B2
(45) Date of Patent: Apr. 4, 2017

(54) WATCH AND BAND WITH LATCH ATTACHMENT

(71) Applicant: Motorola Mobility LLC, Chicago, IL (US)

(72) Inventor: Toshihiro Fujimura, Chicago, IL (US)

(73) Assignee: Motorola Mobility LLC, Chicago, IL (US)

( * ) Notice: Subject to any disclaimer, the term of this patent is extended or adjusted under 35 U.S.C. 154(b) by 0 days.

(21) Appl. No.: 14/697,758

(22) Filed: Apr. 28, 2015

(65) Prior Publication Data

US 2016/0316866 A1 Nov. 3, 2016

(51) Int. Cl.

| | |
|---|---|
| ***A44C 5/20*** | (2006.01) |
| ***A44C 5/22*** | (2006.01) |
| ***A44C 5/24*** | (2006.01) |
| ***G04B 37/14*** | (2006.01) |

(52) U.S. Cl.

CPC ..... *A44C 5/24* (2013.01); *A44C 5/2042* (2013.01); *A44C 5/22* (2013.01); *G04B 37/14* (2013.01)

(58) Field of Classification Search

CPC ..... G04B 37/14; A44C 5/2042; A44C 5/22; A44C 5/24

USPC ..... 368/281, 282; 63/3.1, 3.2, 21, 22

See application file for complete search history.

(56) References Cited

U.S. PATENT DOCUMENTS

| | | | | |
|---|---|---|---|---|
| 1,970,041 A * | 8/1934 | Johnson | A44C 5/24 | 63/3 |
| 2,024,129 A * | 12/1935 | Davignon | A44C 5/24 | 63/3 |
| 2,359,148 A * | 9/1944 | Partridge | A44C 5/16 | 224/164 |
| 2,394,856 A * | 2/1946 | Hickman | A44C 5/24 | 224/164 |
| 2,831,227 A * | 4/1958 | Levine | A44C 5/24 | 24/71 J |

(Continued)

FOREIGN PATENT DOCUMENTS

| | | | |
|---|---|---|---|
| FR | 627330 A * | 10/1927 | A44C 5/24 |

OTHER PUBLICATIONS

Jaeger, English Translation FR 627330, Originally Published Oct. 1, 1927, full document.*

*Primary Examiner* — Amy Cohen Johnson
*Assistant Examiner* — Daniel Wicklund
(74) *Attorney, Agent, or Firm* — Watson Intellectual Property Group

(57) ABSTRACT

The present invention provides a band for encircling another object with latch attachment. The band includes a plurality of layers, combined together in a stacked arrangement, where the front side facing of the first layer will form a front side facing of the band, and the back side facing of the last layer will form a back side facing of the band. A latch attachment including a latch connection point, where the latch attachment is located between two adjacent layers of the plurality of layers at an internal position along a length of the band proximate to one end of the band, but still a distance away from an edge of said one end of the band. Each layer between the location of the latch attachment within the stack of the plurality of layers and the back side facing of the band has a corresponding aligned opening in the layer for exposing the latch connection point through the back side facing of the band.

20 Claims, 7 Drawing Sheets

(56) References Cited

U.S. PATENT DOCUMENTS

| | | | | | |
|---|---|---|---|---|---|
| 3,387,346 | A * | 6/1968 | Hasenbank | A01D 43/06 | 24/270 |
| 3,422,507 | A * | 1/1969 | Ikeda | A44C 5/22 | 24/265 WS |
| 4,330,905 | A * | 5/1982 | Wolfgang | A44C 5/24 | 24/68 J |
| 4,359,808 | A * | 11/1982 | Fontaine | A44C 5/22 | 24/265 WS |
| 4,849,145 | A * | 7/1989 | Hirsch | A44B 11/06 | 264/135 |
| 6,175,729 | B1 * | 1/2001 | He | A44C 5/24 | 343/718 |
| 2002/0125276 | A1 * | 9/2002 | Guyard | A44C 5/185 | 224/164 |
| 2003/0014847 | A1 * | 1/2003 | Hagmann | A44C 5/24 | 24/265 WS |

* cited by examiner

WATCH AND BAND WITH LATCH ATTACHMENT

FIELD OF THE INVENTION

The present invention relates generally to bands with a latch attachment, and more particularly, to bands which include a plurality of layers combined together and which have an integrated latch attachment.

BACKGROUND OF THE INVENTION

Wristbands are encircling strips worn on the wrist. In some instances, the wristband will be formed of a loop of elastic material that can be stretched so as to go over a hand of a user. When the loop clears the hand and is positioned at the wrist of the user, the overall length of the band will generally return at least partially to its pre-stretched length. Alternatively, a wristband can be a single strip of unlooped material where the ends are brought together to form a loop, in place, at the point where the band is intended to be worn.

In some cases the ends of the band are brought together by a latching mechanism, which can open or facilitate a change in the overall length based upon the state of the latching mechanism. The band can transition between an open and a closed state. When open, the band can be more readily initially positioned at one's wrist, and when the band is closed, if the band is located at the wrist, the band will shorten and/or close to more readily stay in place.

An item that commonly involves a wristband is a wristwatch, where the time piece, such as a watch face, is attached to a band, and is worn on the wrist. A wristband such as a band for use with a watch, can sometimes involve multiple layers of material that are combined together. For example, a leather watchband will sometimes include two to three layers of leather material adhered together, and finished with an edge coat.

In order in incorporate a latch, the end of the band is sometimes folded over, and the folded over portion is adhered to the unfolded portion, to form a loop through which one end of the latch can be attached. In other instances, a latch will anchor itself to the end of the watchband using a mechanical fastener. In many instances, mechanical fasteners can add to the bulk of the band, and sometimes involve a visual discontinuity relative to the band, that may not be desirable. Additional bulk can also sometimes negatively impact the fit and comfort, when the band is worn by a user, such as around a wrist.

The present inventors have recognized that integrating at least part of the latch attachment structure, internally, within a multilayer band for coupling to an end of the latch, can provide a secure form of attachment, which has a visually simplified appearance, while avoiding excessive bulk and/or visual discontinuity.

SUMMARY OF THE INVENTION

The present invention provides a band for encircling another object with latch attachment. The band includes a plurality of layers, which are combined together in a stacked arrangement in an order from first to last. Each layer has a front side facing and a back side facing, wherein when stacked, the back side facing of at least the first layer and any intermediate layer between the first layer and the last layer will come into contact with the front side facing of a next adjacent layer within the stack. The front side facing of the first layer will form a front side facing of the band, and the back side facing of the last layer will form a back side facing of the band. The band further includes a latch attachment including a latch connection point. The latch attachment is located between two adjacent layers of the plurality of layers at an internal position along a length of the band proximate to one end of the band, but still a distance away from an edge of said one end of the band. Each layer between the location of the latch attachment within the stack of the plurality of layers and the back side facing of the band has a corresponding aligned opening in the layer for exposing the latch connection point through the back side facing of the band.

In at least one embodiment, the latch attachment extends laterally, between the two adjacent layers that the latch attachment is located, a distance greater than the size of the opening in the layer in at least a first direction.

In at least a further embodiment, the band further includes a latch coupled to the latch attachment. In at least some of these instances, the latch includes one or more hinges which allows a portion of the latch to fold back on itself thereby selectively changing the length of the latch.

The present invention further provides a watch adapted for being worn on a wrist of a user. The watch includes a band, where the band includes a plurality of layers, which are combined together in a stacked arrangement in an order from first to last. Each layer has a front side facing and a back side facing, wherein when stacked, the back side facing of at least the first layer and any intermediate layer between the first layer and the last layer will come into contact with the front side facing of a next adjacent layer within the stack. The front side facing of the first layer will form a front side facing of the band, and the back side facing of the last layer will form a back side facing of the band. The band further includes a latch attachment including a latch connection point. The latch attachment is located between two adjacent layers of the plurality of layers at an internal position along a length of the band proximate to one end of the band, but still a distance away from an edge of said one end of the band. Each layer between the location of the latch attachment within the stack of the plurality of layers and the back side facing of the band has a corresponding aligned opening in the layer for exposing the latch connection point through the back side facing of the band.

These and other objects, features, and advantages of this invention are evident from the following description of one or more preferred embodiments of this invention, with reference to the accompanying drawings.

DETAILED DESCRIPTION OF THE PREFERRED EMBODIMENT(S)

Figure 1:
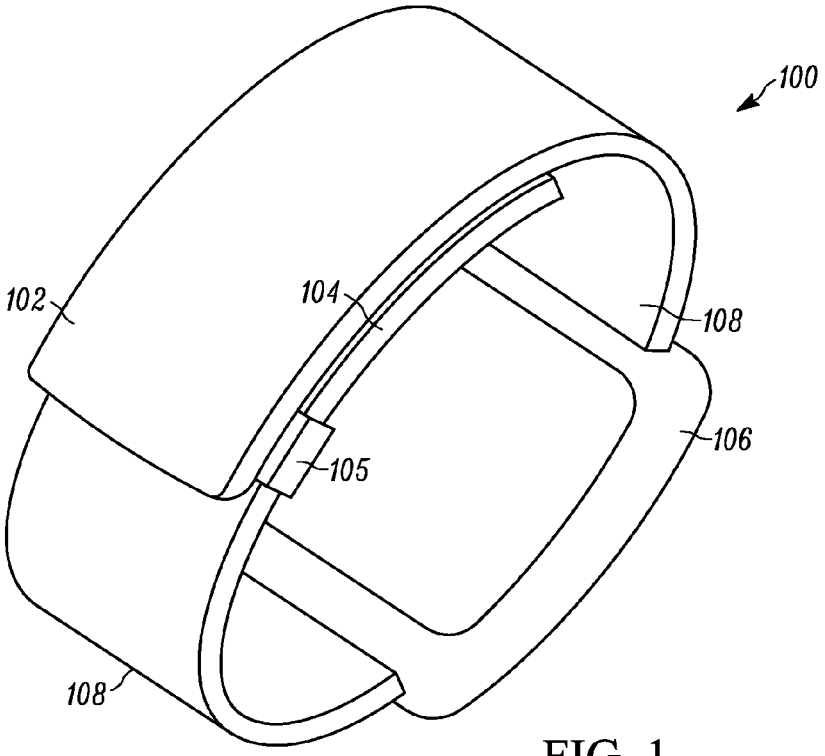
FIG. 1 is a perspective view of an exemplary band.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated. One skilled in the art will hopefully appreciate that the elements in the drawings are illustrated for simplicity and clarity and have not necessarily been drawn to scale. For example, the dimensions of some of the elements in the drawings may be exaggerated relative to other elements with the intent to help improve understanding of the aspects of the embodiments being illustrated and described.

FIG. 1 illustrates a perspective view of an exemplary band 100. In the illustrated embodiment, the ends 102 and 104 of the band 100 have been brought together to form a loop, which can extend around another object, such as the wrist of a user. By controlling the amount of overlap, if any, in the ends 102 and 104 of the band 100, the size of the loop can be adjusted. The ends 102 and 104 of the loop are generally held together by a latch 105, which can be seen in greater detail in FIG. 2.

In the present instance, the band 100 further includes a watch portion 106, that is interspersed between two separate flexible strips 108 of material, which form the respective ends 102 and 104 of the band. The watch portion 106 often includes a face that can be seen by a user, while the band 100 is being worn, that allows a representation of the time to be presented to the user. In the illustrated view, the watch face is on the other side of the watch portion 106, and is not visible. While in the illustrated embodiment, the watch portion 106 is shown interspersed between the two flexible strips 108 of the band 100, it is possible that the band 100 could be formed from a single uninterrupted flexible strip, to which the watch portion 106 could be attached.

Figure 2:
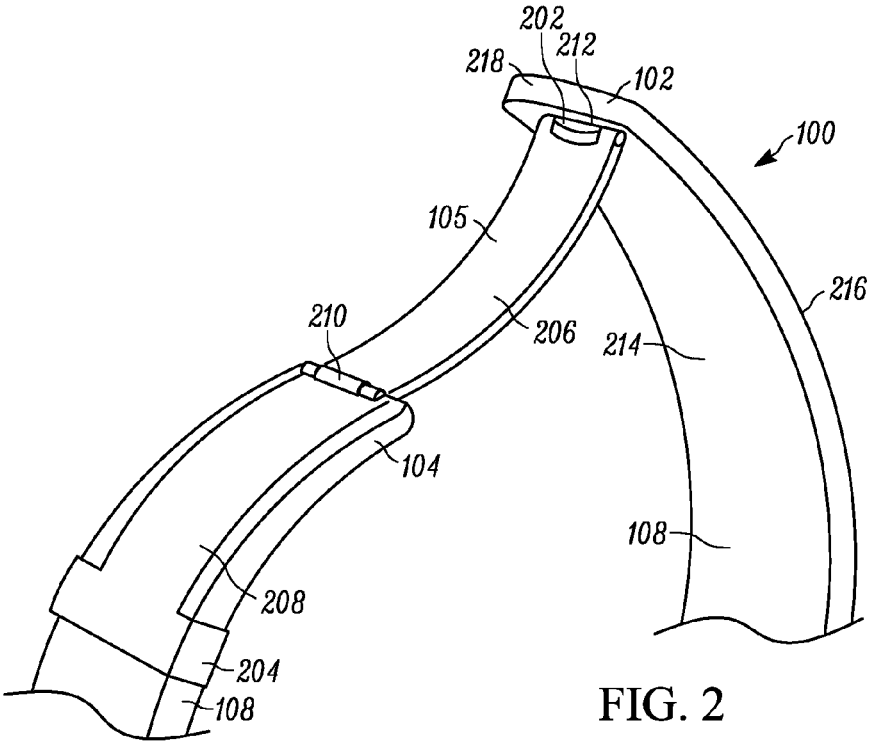
FIG. 2 is a partial perspective view of a band including a latch and corresponding latch attachment, where the latch is coupled to corresponding ends of the band, thereby allowing the band to form a loop.

FIG. 2 illustrates a partial perspective view of the band 100 illustrated in FIG. 1, and includes a more complete view of the latch 105, as well as a portion of respective corresponding latch attachments 202 and 204, where the latch 105 is coupled to corresponding ends of the band 102 and 104, thereby allowing the band 100 to form a loop. In the particular embodiment illustrated, the latch 105 includes two parts 206 and 208 coupled to one another via a hinge 210. The hinge 210 allows the two parts 206 and 208 to rotate relative to one another about the hinge 210 between a closed position, shown in FIG. 1, where the two parts 206 and 208 overlap, and an open position, shown in FIG. 2, where the two parts extend away from the hinge in different non-overlapping directions, which can correspond to an arrangement where the respective parts 206 and 208 extend away from the hinge oftentimes in substantially opposite directions.

By moving between an open position and a closed position, the latch 105 can be used to adjust the overall loop size of the band, where in at least some instances, the two loop sizes can be used to allow for an overall loop size, which corresponds to the latch 105 in the open position, that is large enough for a hand of the user to pass through, as well as an overall loop size, which corresponds to the latch 105 in the closed position, that is large enough to extend around a user's wrist, but not large enough to allow the user's hand to pass through.

In the illustrated embodiment, the latch 105 couples to end 102 of the band 100, via a latch attachment that extends through an opening 212 located on the internal facing 214 of the band 100. The opening 212 extends only partially through the band 100, such that there no corresponding opening on the external facing 216 of the band 100. In at least some instances, where the band 100 includes three or more layers, the opening 212 will be present in an internal layer, and all layers between the internal layer and the internal facing 214 of the band 100. Where the band 100 includes multiple layers the layers are combined together as part of constructing the band. For example, the multiple layers can be adhered, bonded, laminated, glued, or otherwise joined together.

Furthermore, in the illustrated embodiment, the opening 212 is proximate to one end 102 of the band 100, but still a distance away from an edge 218 of the one end 102 of the band 100. The latch 105 couples to the other end 104 of the band 100 via an attachment 204 that extends around the exterior of the band 100 at a distance typically farther away from the end 104 of the band 100, and attaches thereto. In at least some instances, this larger distance away from the end 104 of the band 100 can be adjusted to correspond to one of multiple different distances, which in turn will affect the overall loop size of the band 100, when the latch 105 is both open and closed.

In some instances it is alternatively possible, that instead of maintaining a loop when the band 100 transitions from a closed position to an open position, the ends 102 and 104 of the band 100 will separate. In order to facilitate the ends of the band 100 being able to separate, it is possible that the latch 105 can be adapted and arranged to enable at least one end 102 or 104 of the latch 105 to disengage from its respective latch attachment 202 or 204. In at least some of these embodiments, the latch 105 could be adapted to selectively disengage from the side 102 of the latch 105 that is not as readily adjustable, so as to avoid having to locate the position of the latch attachment 204 when the band 100 is transitioned back to a closed position. However, it is also possible that the latch 105, when transitioning to an open position, could be adapted to selectively disengage from the side 104 of the latch 105 that is more readily adjustable.

Figure 3:
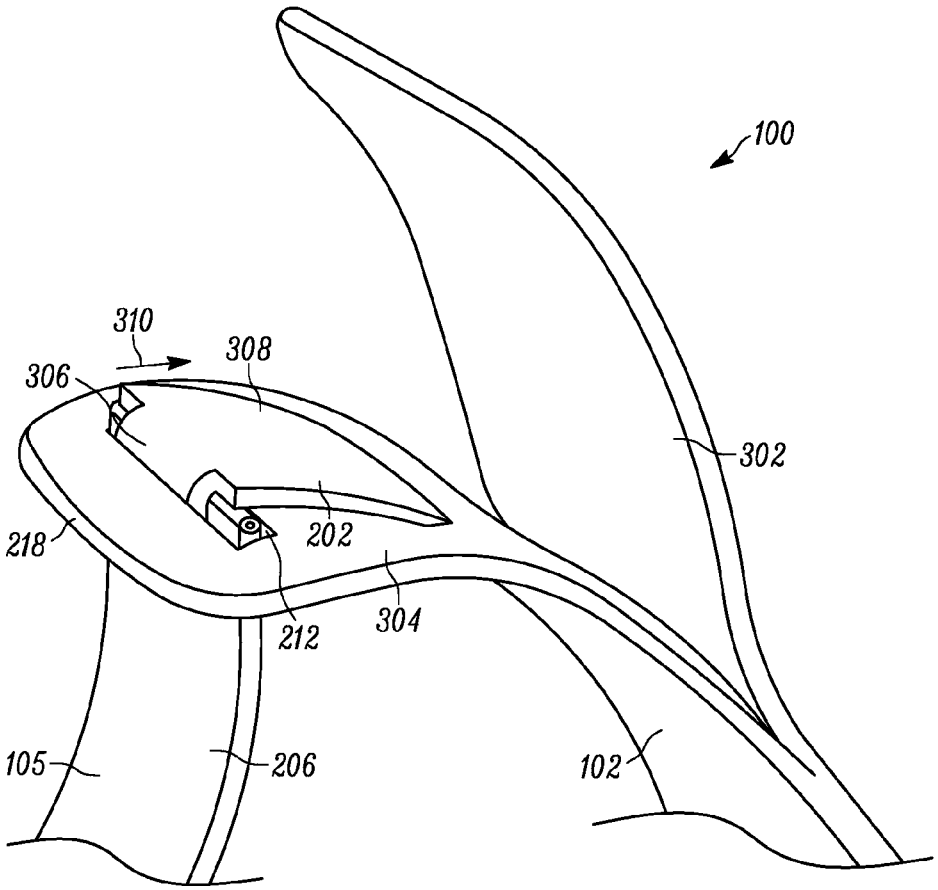
FIG. 3 is a partial perspective view of a band, where two adjacent layers have been separated, which exposes exemplary internal structure corresponding to a latch attachment coupled to one end of a latch.

FIG. 3 illustrates a partial perspective view of a band 100, where two adjacent layers 302 and 304 have been separated, which exposes exemplary internal structure corresponding to a latch attachment 202 adapted for being coupled to one end 206 of a latch 105. The latch attachment 202 includes a latch connection point 306, which is positioned to coincide with the opening 212 which is present in some of the layers 304. In the illustrated embodiment, the latch connection point includes a cylindrical structure having a passage therethrough through which a pin can be at least partially received. The pin can additionally be received in a corresponding passage at one end 206 of the latch 105, which when brought into coupling contact with the latch attachment 202, will have its passage align with the passage present in the cylindrical structure of the latch connection point 306.

In at least some instances, the latch attachment 202 can additionally include a portion, which extends laterally, between the two adjacent layers that the latch attachment is located. In the illustrated embodiment, the portion 308 extends generally in at least a first direction 310 a distance greater than the size of the opening 212 in the layers 304. In addition to being captivated internally within a space between the two adjacent layers, when the layers are adhered together, the portion that extends beyond the size of the opening can have its surface roughened up or can include additional structure, not shown, that might help to resist movement by increasing the friction or otherwise avoid slippage between the latch attachment 202 and the internal layers of the band 100. Examples of additional structure that might help to resist movement can include ridges or small protrusions, such as spikes, which might press into at least partially the material forming the band.

In at least the illustrated embodiment, the ends 102 and 104 of the band 100 are formed from a generally flexible material, which makes the same pliable and capable of bending around so as to form a loop. Examples of suitable flexible materials include leather, silicone, neoprene, nylon and some plastics. Alternatively, in at least some instances, the latch attachment 202 is formed from a substantially rigid material, such as a metal, a metal alloy, and/or some plastics.

Figure 4:
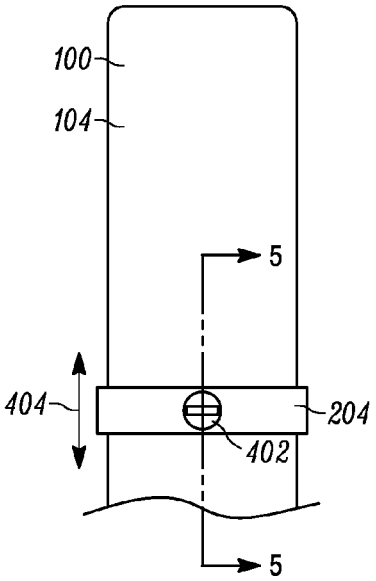
FIG. 4 is an inside facing view of the band having an adjustable external latch attachment.
Figure 5:
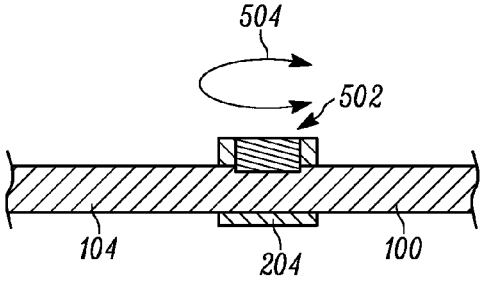
FIG. 5 is a cross sectional side view of the adjustable external latch attachment, illustrated in FIG. 4.

FIG. 4 illustrates an inside facing view of the band 100 having an adjustable external latch attachment 204. FIG. 5 illustrates a cross sectional side view of the adjustable external latch attachment 204, illustrated in FIG. 4. More specifically, the latch attachment 204 is shown coupled to the end 104 of the band 100. In the illustrated embodiment, the latch attachment 204 includes a threaded fastener 402 received in a cylindrical passage 502 which has corresponding threads which mate with helical threads associated with the threaded fastener 402. The threaded fastener 402 relative to the cylindrical passage 502 can be rotated 504, resulting in the fastener laterally traversing within the passage 502 and the end of the threaded fastener 402 being tightened or loosened relative to band 100, so as to apply more or less pressure against the band material extending through the latch attachment 204. When loosened sufficiently, the location of the latch attachment can be adjusted in a direction 404 that is substantially parallel to the lengthwise direction of the band 100. When the latch attachment is adjusted to the desired location, the threaded fastener can be correspondingly tightened, thereby resisting further movement of the latch attachment 204 relative to the band 100.

Figure 6:
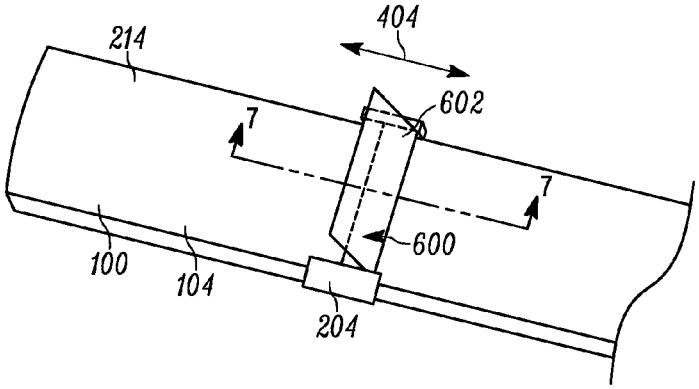
FIG. 6 is a perspective view of an alternative embodiment of providing an adjustable external latch attachment.
Figure 7:
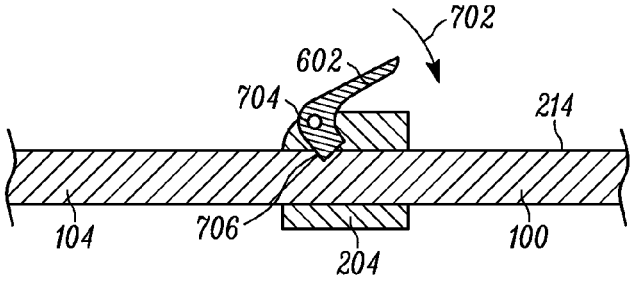
FIG. 7 is a cross sectional side view of the adjustable external latch attachment, illustrated in FIG. 6.

FIG. 6 illustrates a perspective view of an alternative embodiment of providing an adjustable external latch attachment 204. FIG. 7 illustrates a cross sectional side view of the adjustable external latch attachment 204, illustrated in FIG. 6. In the present instance, a latch attachment 204 is shown coupled to the end 104 of the band. The latch attachment 204 includes a cam mechanism 600, which when an arm 602 is pivoted 702 about a pin 704, the amount of pressure applied to the band 100 by a tooth 706 which pivots with the arm 602 is changed. When the arm 602 is lifted, the amount of pressure applied to the band 100 by the tooth 706 is reduced, whereby the reduced pressure makes it easier to move the location of the latch attachment 204 relative to the band 100 in a direction 404 along the length of the band 100. When the arm 602 is closed by lowering the same toward a substantially flush position, which in the illustrated embodiment is substantially parallel with the internal facing surface 214 of the band 100, the amount of pressure is increased. The increased pressure serves to restrict the movement of the latch attachment 204 relative to the band 100, thereby helping to resist further changes in the position of the latch attachment 204.

Figure 8:
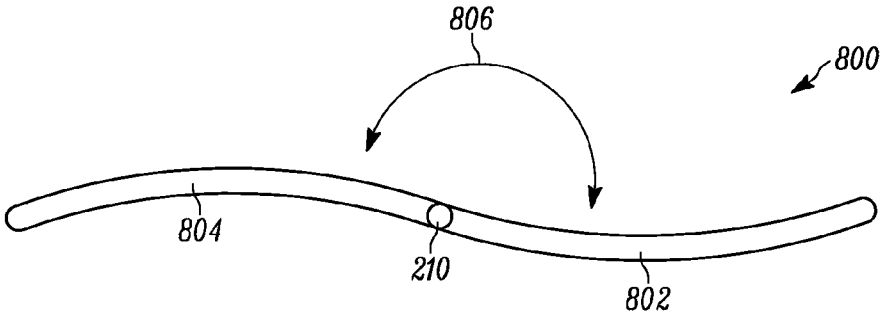
FIG. 8 is a side view of an exemplary oyster type clasp mechanism of a latch having a hinge.

FIG. 8 illustrates a side view of an exemplary oyster type clasp mechanism 800 of a latch 105 having a hinge 210, where when the portion on a first side 802 of the hinge 210 is rotated about the hinge 210 so as to coincide with the portion 804 on the second side of the hinge 210, the clasp mechanism 800 can transition 806 the latch 105 between an open and a closed position. While the mechanism has been described with a single hinge 210, other related mechanisms of a different type can include additional hinges.

Figure 9:
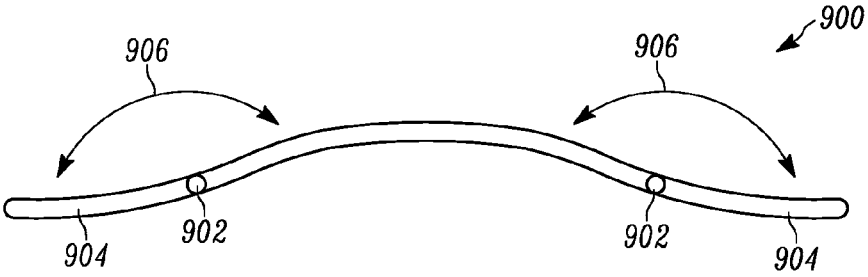
FIG. 9 is a side view of an exemplary butterfly type clasp mechanism of a latch having a pair of hinges.

FIG. 9 illustrates a side view of an exemplary butterfly type clasp mechanism 900 of a latch, which has a pair of hinges 902 with the principal difference relative to the oyster type clasp mechanism is the number of segments 904 that can rotate 906 between overlapping and non-overlapping positions. One skilled in the art will appreciate that still further configurations with the same or different number of hinges are possible without departing from the teachings of the present invention.

Figure 10A:
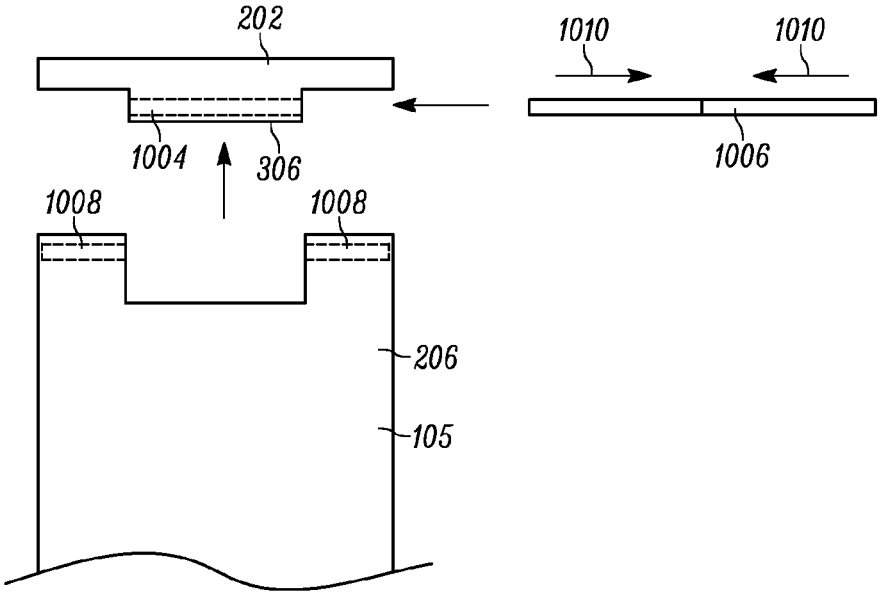
FIG. 10A is an exploded partial view of a latch attachment to be integrated into a band, and an end of a latch mechanism to be attached thereto.
Figure 10B:
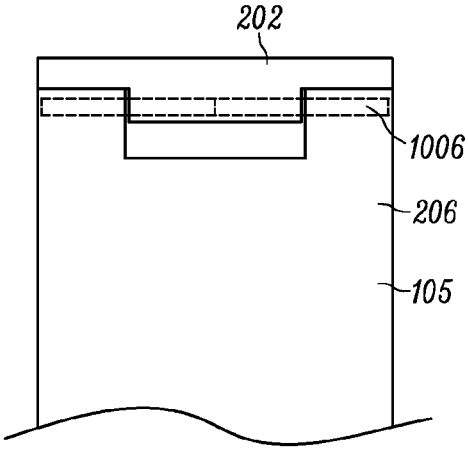
FIG. 10B is an unexploded partial view of the latch attachment and the end of the latch mechanism coupled to the latch attachment, which is illustrated in FIG. 10A.

FIG. 10A illustrates an exploded partial view of a latch attachment 202 to be integrated into a band 100, and an end 206 of a latch 105 to be attached thereto. In the illustrated embodiment, a connection point 306 of the latch attachment 202 includes a cylindrical structure having a passage 1004 through which a coupling pin 1006 can be at least partially received. The pin 1006 can additionally be received in a corresponding passage 1008 at one end 206 of the latch 105, which when brought into coupling contact with the latch attachment 202, will have its passages 1008 align with the passage 1004 through the cylindrical structure of the latch connection point 306. In order to help the pin selectively move between an engagement position, where the end 206 of the latch is coupled to the latch attachment 202, and a non-engagement position, where the end 206 of the latch can be separated from the latch attachment 202, in at least some instances, the length of the pin 1006 can be compressed 1010, as well as allowed to return to its uncompressed length. FIG. 10B illustrates an unexploded partial view of the latch attachment 202, and the end 206 of the latch 105, which is coupled to the latch attachment 202, illustrated in FIG. 10A.

Figure 11:
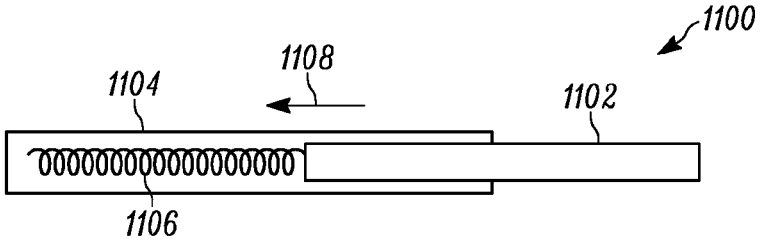
FIG. 11 is a cross sectional side view of a coupling pin for use in connecting the end of a latch to a latch attachment, in accordance with at least one embodiment.

FIG. 11 illustrates a cross sectional side view of a coupling pin 1100 for use in connecting the end 206 of a latch 105 to a latch attachment 202, in accordance with at least one embodiment. In the embodiment shown, the coupling pin 1100 includes two nesting rods 1102 and 1104. The first one 1102 of the nesting rods has a smaller outer circumference and fits within an internal channel and open end of the second one 1104 of the nesting rods. The internal channel additionally includes a compression/tension device, such as a spring 1106. The spring 1106 has an unbiased resting length that when stretched or compressed will result in the spring 1106 exerting a force biasing itself until it returns back to its unstretched/uncompressed length. The coupling pin 1100 can be at least temporarily shortened by applying a force 1108 on the first one 1102 of the two nesting rods relative to the second one 1104 of the two nesting rods causing the spring 1106 to compress. The spring will then exert a force on the two nesting rods biasing the two rods of the coupling pin back to its unshortened length.

Figure 12:
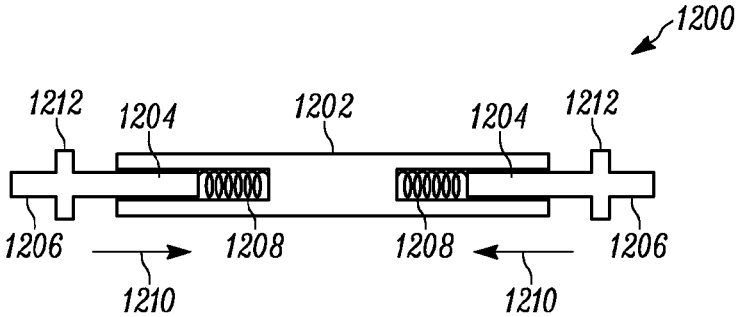
FIG. 12 is a cross sectional side view of a coupling pin for use in connecting the end of a latch to a latch attachment, in accordance with at least a further embodiment.

FIG. 12 illustrates a cross sectional side view of a coupling pin 1200 for use in connecting the end 206 of a latch 105 to a latch attachment 202, in accordance with at least a further embodiment. In the embodiment shown, the coupling pin 1200 includes a generally cylindrical shaped center section 1202, which has two channels 1204 extending partially in toward the center from the opposite ends of the center section. Each of the two channels 1204 include a respective sub pin 1206 that is sized to be at least partially received within one of the channels 1204. Also located within each of the channels 1204 is a spring 1208 which will compress as one pushes 1210 the sub pin 1206 further into the channel 1204. When compressed, the spring 1208 will attempt to bias at least a portion of the respective sub pin 1206 out of the channel 1204. In the illustrated embodiment, the sub pins additionally include a collar 1212, which limits the amount that the sub pins 1206 can be inserted into the channels 1204. While in the illustrated embodiment the center section 1202 is shown as being separate from the latch attachment 202, in some instances the center section 1202 could be incorporated into and as part of the connection point 306 of the latch attachment 202.

Figure 13:
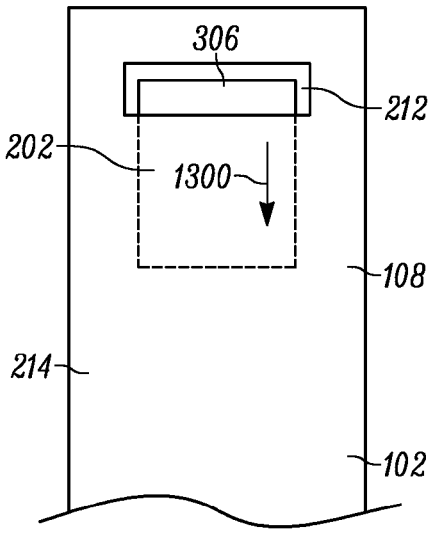
FIG. 13 is a partial inside facing view of an end of a band having an integrated latch attachment for attaching to one end of a latch, in accordance with one embodiment.

FIG. 13 illustrates a partial inside facing 214 view of an end 102 of a band 100 having an integrated latch attachment 202 for attaching to one end of a latch 105, in accordance with one embodiment. The dashed lines show the outline of the latch attachment 202 that is included within the structure of the band 100 between two adjacent layers, that does not coincide with the opening 212 through which the latch connection point 306 is exposed. In at least some instances, the latch attachment 202 extends laterally a distance greater than the size of the opening 212 in at least a first direction 1300.

Figure 14:
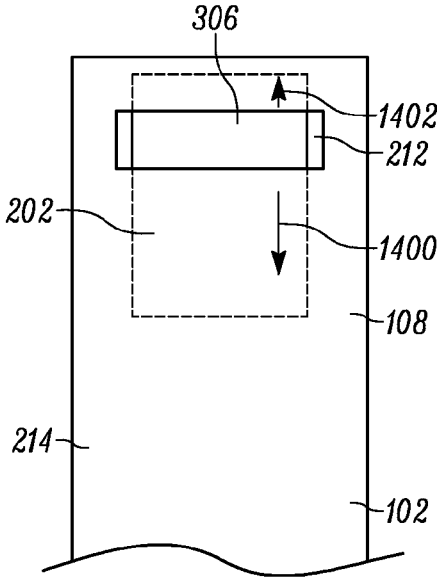
FIG. 14 is a partial inside facing view of an end of a band having an integrated latch attachment for attaching to one end of a latch, in accordance with a further embodiment.
Figure 15:
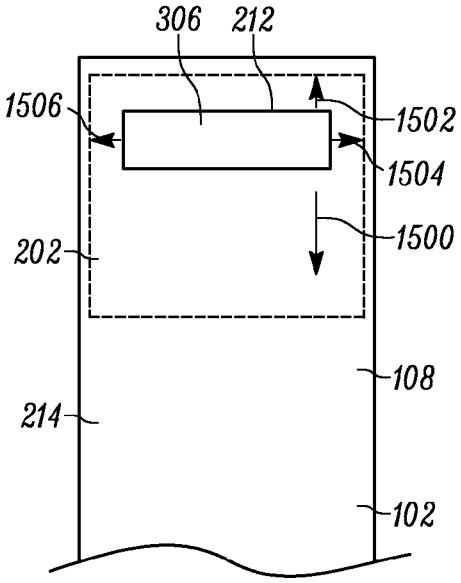
FIG. 15 is a partial inside facing view of an end of a band having an integrated latch attachment for attaching to one end of a latch, in accordance with a still further embodiment.

FIG. 14 illustrates a partial inside facing 214 view of an end 102 of a band 100 having an integrated latch attachment 202 for attaching to one end of a latch 105, in accordance with a further embodiment, where the latch attachment 202 extends laterally a distance greater than the size of the opening 212 in at least a pair of directions 1400 and 1402. FIG. 15 illustrates a partial inside facing 214 view of an end 102 of a band 100 having an integrated latch attachment 202 for attaching to one end of a latch 105, in accordance with a still further embodiment. In the still further embodiment, the latch attachment can extend beyond the size of the opening in all four directions 1500, 1502, 1504 and 1506. In some instance, the latch attachment 202 may extend all the way to the edge, where the latch attachment 202 may be partially exposed through the sides 1510 of the band 100, and can have a decorative effect.

In this way an latch attachment 202 can be provided, where at least part of the latch attachment structure is located, internally, within a multilayer band for coupling to an end of the latch, which can provide a secure form of attachment, that has a visually simplified appearance, while avoiding excessive bulk and/or visual discontinuity.

While the preferred embodiments of the invention have been illustrated and described, it is to be understood that the invention is not so limited. Numerous modifications, changes, variations, substitutions and equivalents will occur to those skilled in the art without departing from the spirit and scope of the present invention as defined by the appended claims.

What is claimed is:

1. A band for encircling another object with latch attachment, said band comprising:

a plurality of layers, combined together in a stacked arrangement in an order from first to last, each layer having a front side facing and a back side facing, wherein when stacked, the back side facing of at least the first layer and any intermediate layer between the first layer and the last layer will come into contact with the front side facing of a next adjacent layer within the stack, where the front side facing of the first layer will form a front side facing of the band, and the back side facing of the last layer will form a back side facing of the band; and a latch attachment including a latch connection point, where the latch attachment is located between two adjacent layers of the plurality of layers at an internal position along a length of the band proximate to one end of the band, but still a distance away from an edge of said one end of the band, wherein each layer between the location of the latch attachment within the stack of the plurality of layers and the back side facing of the band has a corresponding aligned opening in the layer for exposing the latch connection point through the back side facing of the band.

2. The band for encircling another object with latch attachment in accordance with claim 1, wherein the combined together plurality of layers are combined by adhering together the adjacent layers in the plurality of layers.

3. The band for encircling another object with latch attachment in accordance with claim 1, wherein the combined together plurality of layers are combined by laminating together the adjacent layers in the plurality of layers.

4. The band for encircling another object with latch attachment in accordance with claim 1, wherein the latch attachment extends laterally, between the two adjacent layers that the latch attachment is located, a distance greater than the size of the opening in the layer in at least a first direction.

5. The band for encircling another object with latch attachment in accordance with claim 4, wherein the latch attachment extends laterally a distance greater than the size of the opening in the layer in a pair of directions.

6. The band for encircling another object with latch attachment in accordance with claim 5, wherein the pair of directions extend in opposite directions.

7. The band for encircling another object with latch attachment in accordance with claim 6, where the pair of opposite directions are substantially parallel to the direction that the band extends while encircling the another object.

8. The band for encircling another object with latch attachment in accordance with claim 1, wherein the plurality of layers is formed from a flexible material.

9. The band for encircling another object with latch attachment in accordance with claim 1, wherein the latch attachment is formed from a rigid material.

10. The band for encircling another object with latch attachment in accordance with claim 1, further comprising a latch coupled to the latch attachment.

11. The band for encircling another object with latch attachment in accordance with claim 10, wherein the latch is coupled to the latch attachment via a pin.

12. The band for encircling another object with latch attachment in accordance with claim 10, wherein the latch includes one or more hinges which allows a portion of the latch to fold back on itself thereby selectively changing the length of the latch.

13. The band for encircling another object with latch attachment in accordance with claim 10, wherein in addition to being coupled to the latch attachment, the latch is coupled to an other end of the band opposite the location of the latch attachment, thereby causing the band to form a loop.

14. The band for encircling another object with latch attachment in accordance with claim 13, wherein a point of attachment where the latch is coupled to the other end of the band is an adjustable distance away from an end edge of the other end of the band.

15. The band for encircling another object with latch attachment in accordance with claim 14, wherein the latch is coupled to the other end of the band via a lock screw, wherein the lock screw when tightened presses into the plurality of layers.

16. The band for encircling another object with latch attachment in accordance with claim 14, wherein the latch is coupled to the other end of the band via a cam type lever adjustment having a cam lever, which when closed will have an edge which presses into the plurality of layers.

17. The band for encircling another object with latch attachment in accordance with claim 10, wherein the latch is one of an oyster clasp or a butterfly clasp.

18. The band for encircling another object with latch attachment in accordance with claim 1, wherein along the length of the band, the band includes a watch face.

19. The band for encircling another object with latch attachment in accordance with claim 18, wherein the watch face is located proximate the midway point along the length of the band.

20. A watch adapted for being worn on a wrist of a user, said watch comprising:

a band including a plurality of layers, combined together in a stacked arrangement in an order from first to last, each layer having a front side facing and a back side facing, wherein when stacked, the back side facing of at least the first layer and any intermediate layer between the first layer and the last layer will come into contact with the front side facing of a next adjacent layer within the stack, where the front side facing of the first layer will form a front side facing of the band, and the back side facing of the last layer will form a back side facing of the band; and a latch attachment including a latch connection point, where the latch attachment is located between two adjacent layers of the plurality of layers at an internal position along a length of the band proximate to one end of the band, but still a distance away from an edge of said one end of the band, as well as a distance away from each respective side edge of the band, wherein each layer between the location of the latch attachment within the stack of the plurality of layers and the back side facing of the band has a corresponding aligned opening in the layer for exposing the latch connection point through the back side facing of the band;

a latch coupled to the latch attachment at a first end of the band, and to a second end of the band, thereby causing the band to form a loop; and a watch face located proximate the midway point along the length of the band.

* * * * *